US005622213A

United States Patent [19]

McKelvie

[11] Patent Number: 5,622,213

[45] Date of Patent: Apr. 22, 1997

[54] FLYING LOG TURNER

[75] Inventor: Monte J. McKelvie, Quesnel, Canada

[73] Assignee: Linden Welding & Fabricating Ltd., Quesnel, Canada

[21] Appl. No.: 499,883

[22] Filed: Jul. 11, 1995

[51] Int. Cl.[6] ..... B27B 31/00

[52] U.S. Cl. ..... 144/246.2; 144/248.5; 144/357; 198/782; 414/766

[58] Field of Search ..... 144/242.1, 246.1, 144/246.2, 248.4, 248.5, 248.6, 356, 357; 198/624, 780, 782, 590; 414/766, 787

[56] References Cited

U.S. PATENT DOCUMENTS

| | | | |
|---|---|---|---|
| 2,897,859 | 8/1959 | Annis, Jr. | 144/248.5 |
| 4,027,769 | 6/1977 | Hasenwinkle et al. | 198/782 |
| 4,471,823 | 9/1984 | Wadell | 144/248.5 |
| 4,505,377 | 3/1985 | Sundberg | 144/245.1 |
| 5,081,818 | 1/1992 | Poloni | 414/766 |
| 5,400,841 | 3/1995 | Holbert | 144/356 |

*Primary Examiner*—W. Donald Bray
*Attorney, Agent, or Firm*—Townsend and Townsend and Crew LLP

[57] ABSTRACT

Apparatus for rotating a log delivered by an infeed conveyor about its longitudinal axis for delivery to an outfeed conveyor comprising a main frame and a rotatable housing mounted in the main frame having a passage therethrough to receive a log from the infeed conveyor. Log gripping spike rolls are mounted adjacent the passage and are adapted to grip the log while permitting continuous forward movement of the log along its longitudinal axis through the passage to the outfeed conveyor. The spike rolls are mounted to the rotatable housing for movement with the housing. A drive motor rotates the rotatable housing through a selected angle to rotate the longitudinal axis of the log held in the spike rolls.

16 Claims, 5 Drawing Sheets

FLYING LOG TURNER

FIELD OF THE INVENTION

This invention relates to apparatus for handling of logs, and more particularly, to apparatus for rotating a log to be processed about its longitudinal axis.

BACKGROUND OF THE INVENTION

In the log processing industry it is becoming more common to automate the processing of raw logs into end products as automation offers significant advantages in terms of processing speed, reliability and cost.

In any processing operation handling raw logs, the logs are generally carried on conveyor belts between processing equipment that performs specific tasks on the logs. For example, in the processing of logs into sawed lumber, there are a number of steps involved. First, a group of raw logs are processed by singulating equipment that separates the group into individual logs. Each individual log is then processed by de-barking equipment. The logs are then fed on a conveyor past scanning equipment that analyses the cross-sectional area of each log and determines the orientation of the log for maximum recovery or conversion into saleable product. The log is then passed by orienting equipment that rotates the log to the desired orientation and onto the sawing equipment that cuts the log into raw lumber. An additional step may also involve cutting the logs into set lengths at some stage in the process.

An important part of the automatic processing of logs as outlined above is the orientation of the log to ensure maximum recovery. Equipment known as "flying vertical rolls" have been developed to adjust the orientation of logs in response to control signals generated by computer scanning equipment. The scanning equipment determines the angle to which a log should be rotated and the "flying vertical rolls" carry out the rotation of the log about its longitudinal axis. Conventional equipment comprises one or more pairs of spaced, upstanding spike rolls positioned on either side of a conveyor belt that define a passage through which a log to be rotated passes. The spike rolls are cylindrical members with radially extending spikes to grip and engage the log. The upstanding spike rolls are driven to rotate about their vertical axis thereby causing a log in the passage between the rolls to be advanced forward. The term "flying" in the name of the equipment refers to the fact that the log moves continuously through the passage even as it is being oriented. The spike rolls are also adapted for movement along the vertical axis about which they rotate. Moving a spike roll on one side of a log along the vertical axis while maintaining the position of the spike roll on the other side of the log causes the log to rotate to a new angle.

The "flying vertical roll" equipment does perform its job of rotating logs, however, it suffers from the significant drawback that accurate angular rotation of a log is difficult to achieve. The math needed to calculate the vertical movements of one or more spike rolls to rotate a log through a selected angle is quite complex. Because a log is essentially a tapered cylinder, rotating the log axis through a given angle by a tangential vertical movement at the perimeter of the log will depend on the circumference of the log at the point of engagement of the spike rolls. Therefore, it is necessary to take into account the feed speed of the log through the equipment and the time of engagement with the spike rolls so that the equipment will be able to calculate the circumference of the portion of the log that is engaged by the spike rolls when the log is to be rotated. Logs tend to have a curvature or "sweep" and this must also be taken into account when determining the vertical movement of a spike roll. It is easy to see that the accuracy of operation of the flying vertical roll is compromised when one considers that logs are asymmetrical and knots or other defects in the log will result in slippage of the log through the spike roll. The bottom line is that it is difficult to achieve optimum angular positioning of a log using the flying vertical roll.

SUMMARY OF THE INVENTION

Accordingly, there is a need for log turning equipment that avoids the drawbacks of the prior art as set out above. Applicant has developed log turning equipment that includes gripping members to engage a log to be rotated and that achieves rotation of the longitudinal axis of the log by rotating the log and the gripping members as a unit through the desired angle thereby avoiding the inherently inaccurate rotation system of the prior art with its reliance on translating vertical movements into angular rotations of non-cylindrical logs.

Accordingly, the present invention provides apparatus for rotating a log delivered by an infeed conveyor about its longitudinal axis for delivery to an outfeed conveyor comprising:

a main frame;

a rotatable housing mounted in the main frame having a passage therethrough to receive a log from the infeed conveyor;

log gripping means adjacent the passage adapted to grip the log while permitting continuous forward movement of the log along its longitudinal axis through the passage to the outfeed conveyor, the log gripping means being mounted to the rotatable housing for movement with the housing; and drive means to rotate the rotatable housing through a selected angle to rotate the longitudinal axis of the log held in the gripping means.

The apparatus of the present invention performs its rotation of the log to a desired angle while the log is in continuous longitudinal movement through the apparatus thus qualifying it as a "flying" log turner.

The log gripping means comprises a plurality of spike rolls pivotally mounted to the rotatable housing to accept logs of varying diameter.

BRIEF DESCRIPTION OF THE DRAWINGS

Aspects of the present invention are illustrated, merely by way of example, in the accompanying drawings in which.

DESCRIPTION OF THE PREFERRED EMBODIMENTS

Figure 1:
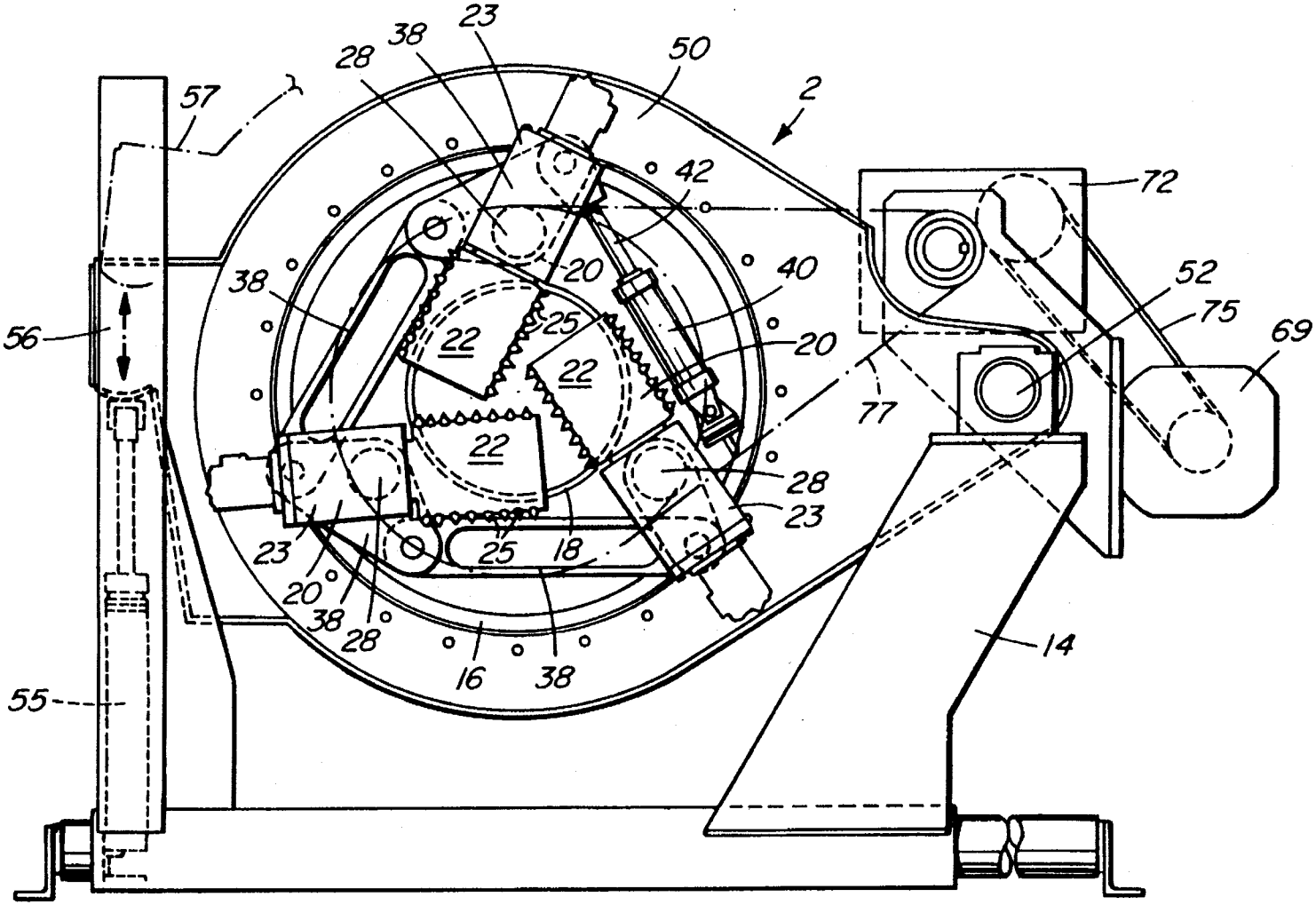
FIG. 1 is an elevation view of apparatus for turning logs according to a preferred embodiment of the present invention.
Figure 2:
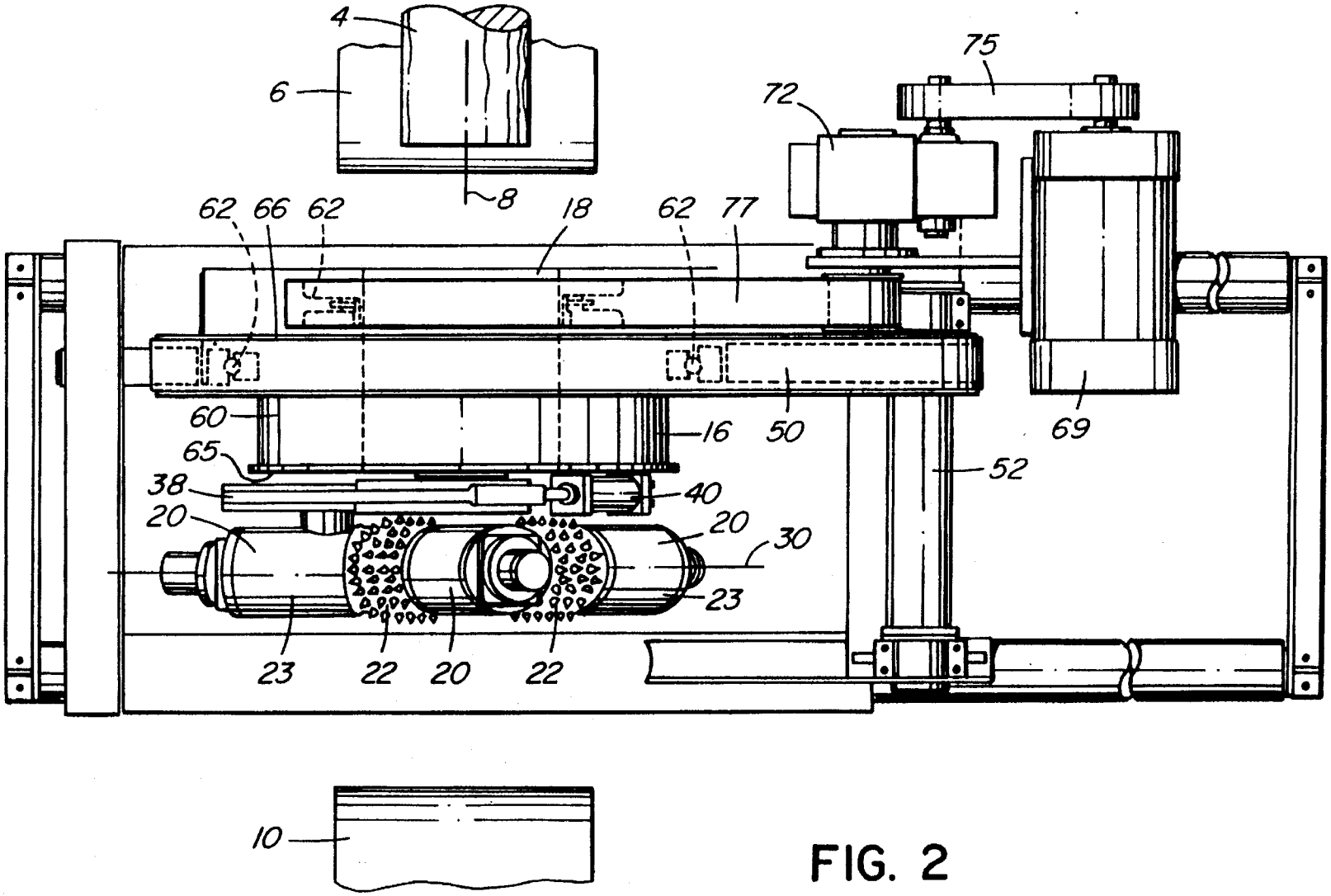
FIG. 2 is a plan view of the apparatus of FIG. 1.

Referring to FIGS. 1 and 2, there is shown a flying log turning apparatus 2 according to a preferred embodiment of the present invention. As best shown in FIG. 2, the flying log turner 2 acts to rotate a log 4 delivered by an infeed conveyor 6 about the log's longitudinal axis 8 for delivery to an outfeed conveyor 10 which transports the oriented log to further processing equipment (not shown).

As best shown in FIG. 1, log turner 2 comprises a main frame 14 that is mounted to a solid support surface. A rotatable housing 16 is mounted in the main frame and has a central passage 18 extending through the housing to receive a log 4 from the infeed conveyor 6. Passage 18 is surrounded by log gripping means comprising a plurality of pivoting gripping members 20 that are adapted to grip the log as it passes through passage 18. Gripping members 20 are mounted to rotatable housing 16 and move with the housing.

Figure 3:
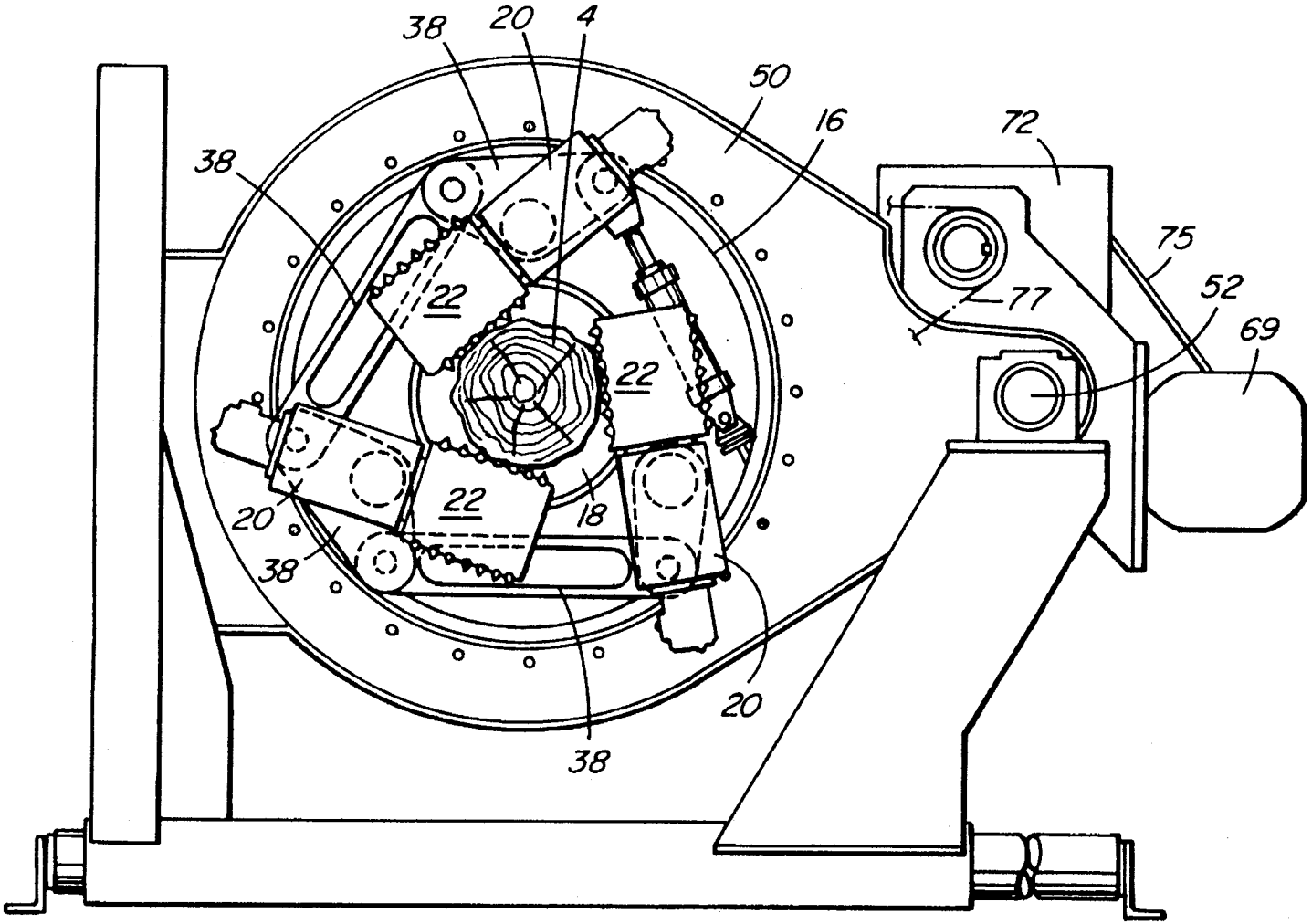
FIG. 3 is an elevation view showing the apparatus engaging a log.

In the illustrated embodiment of FIGS. 1–3, there are three gripping member 20 that are pivotable into and out of central passage 18 and co-operate to engage logs of varying dimensions as the logs come through passage 18. It will be readily apparent to those skilled in the art the alternative arrangements of gripping members are possible for gripping and holding logs as they move through passage 18. For example, different numbers of gripping members may be used and the position of the gripping members can be varied. In the illustrated embodiment, the gripping members are positioned on rotatable housing 16 at the end of passage 18 to engage a log after the front end of the log has already travelled through passage 18. Alternatively, gripping members 20 can be positioned at the start of passage 18.

Each gripping member 20 comprises a spike roll 22 and an associated actuator comprising a drive motor 23. Spike roll 22 is a cylindrical body with radially extending spikes 25 that are engageable with a log. Each spike roll is mounted to its associated drive motor 23 for rotary motion about an axis at right angles to the longitudinal axis of a log moving through passage 18. Preferably, drive motor 23 is a hydraulic motor, however, other types of drive units are possible such as electric or pneumatic motors. When spikes 25 of the various driven spike rolls engaging a log 4, the log is continuously moved forward through central passage 18 along the log's longitudinal axis to the outfeed conveyor.

The gripping members are pivotally mounted to the rotatable housing 16 at joints 28 to permit movement of the gripping members in a plane 30 perpendicular to the longitudinal axis of a log (see FIG. 2). This allows the spike rolls 22 to be pivoted from a closed position shown in FIG. 1 in which all spike rolls are pivoted inwardly into passage 18 for handling small diameter logs to more open positions as shown in FIG. 3 in which the spike rolls are pivoted outwardly with respect to passage 18 to accommodate large diameter logs.

Gripping members 20 are preferably connected by a system of pivoting links 38 that allows a single actuator comprising hydraulic cylinder 40 to adjust the position of the gripping members between the closed and opened positions by extending or retracting the cylinder rod 42. Preferably, cylinder 40 is fitted with a sensor that detects when the cylinder encounters resistance indicating that the spike rolls have engaged a log. In the illustrated example, the actuator that controls the pivoting link system is a hydraulic cylinder, but it will be readily apparent that other actuators such as an electric motor or pneumatic cylinder can be used.

In addition to adjusting the position of the gripping members, it is desirable to be able to adjust the position of rotatable housing 16 and central passage 18 for alignment with the longitudinal axis of logs 4 fed from infeed conveyor 6. Means for adjusting the position of the rotatable housing comprises an arm 50 pivotally mounted to the main frame 14 by axle 52. Arm 50 includes rotatable housing 16 and employs means to pivot the arm in the form of hydraulic cylinder 55. Cylinder 55 engages against protrusion 56 formed on arm 50 opposite pivoting axle 52. Cylinder 55 acts to adjust the position of the rotatable housing between a lowered position shown in solid lines in FIG. 1 and a raised position shown by dashed lines 57 to accommodate different diameter logs that are transported to the apparatus by infeed conveyor 6 which remains at a constant level.

As best shown in FIG. 2, rotatable housing 16 comprises a hollow cylindrical member 60 that extends through arm 50 and is supported in the arm for rotatable movement by a bearing 62. To ensure smooth and reliable rotation of housing 16 multiple bearings can be employed. The hollow centre of member 60 defines central passage 18 for passage of a log. The front face 65 of cylindrical member 60 supports gripping members 20 for rotatable movement. The rear face 66 of member 60 has an attached drive pulley 62 that is used to rotate cylindrical member 60 with respect to arm 50 and the rest of main frame 14. Drive means comprising a motor 69 is used to rotate member 60. Preferably, motor 69 drives a gear reducer 72 through belt 75 and reducer drives pulley 62 through belt 77.

As best shown in FIG. 3, when a log 4 is engaged by spike rolls 22 of gripping members 20, the driven rolls advance the log through central passage 18 along the log's longitudinal axis. At the same time, rotatable housing 16 is rotated by motor 69 to a selected angle to rotate the gripping members and the engaged log through the same angle. The outfeed conveyor 10 is equipped with press rolls that ensure that the oriented position of the log is maintained for delivery of the log to downstream processing equipment.

The apparatus of the present invention is desirably controlled by conventional sensor equipment (not shown) upstream of the apparatus to permit automatic operation. The sensor equipment scans and measures the log to determine the cross-sectional area of the log and determines the angle of rotation of the log for maximum recovery. The sensor equipment then provides a first control signal to hydraulic cylinder 55 to pivot arm 50 to align with the longitudinal axis of the log and a second control signal to motor 69 to rotate rotatable housing 16 through an angle corresponding to the angle necessary to orient the log for maximum recovery.

Figure 4:
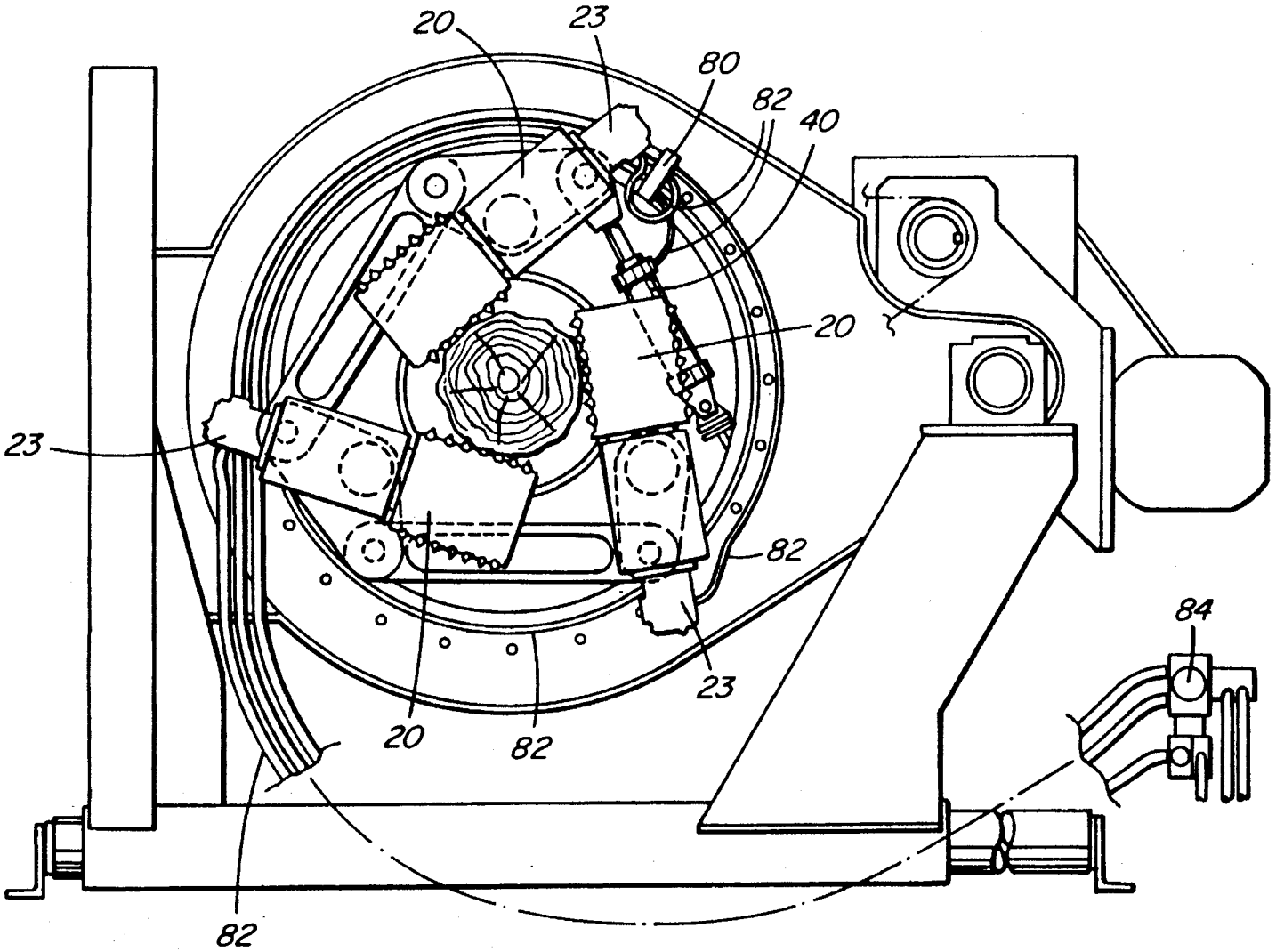
FIG. 4 is elevation view showing a hydraulic fluid distribution system for use with the apparatus.
Figure 5:
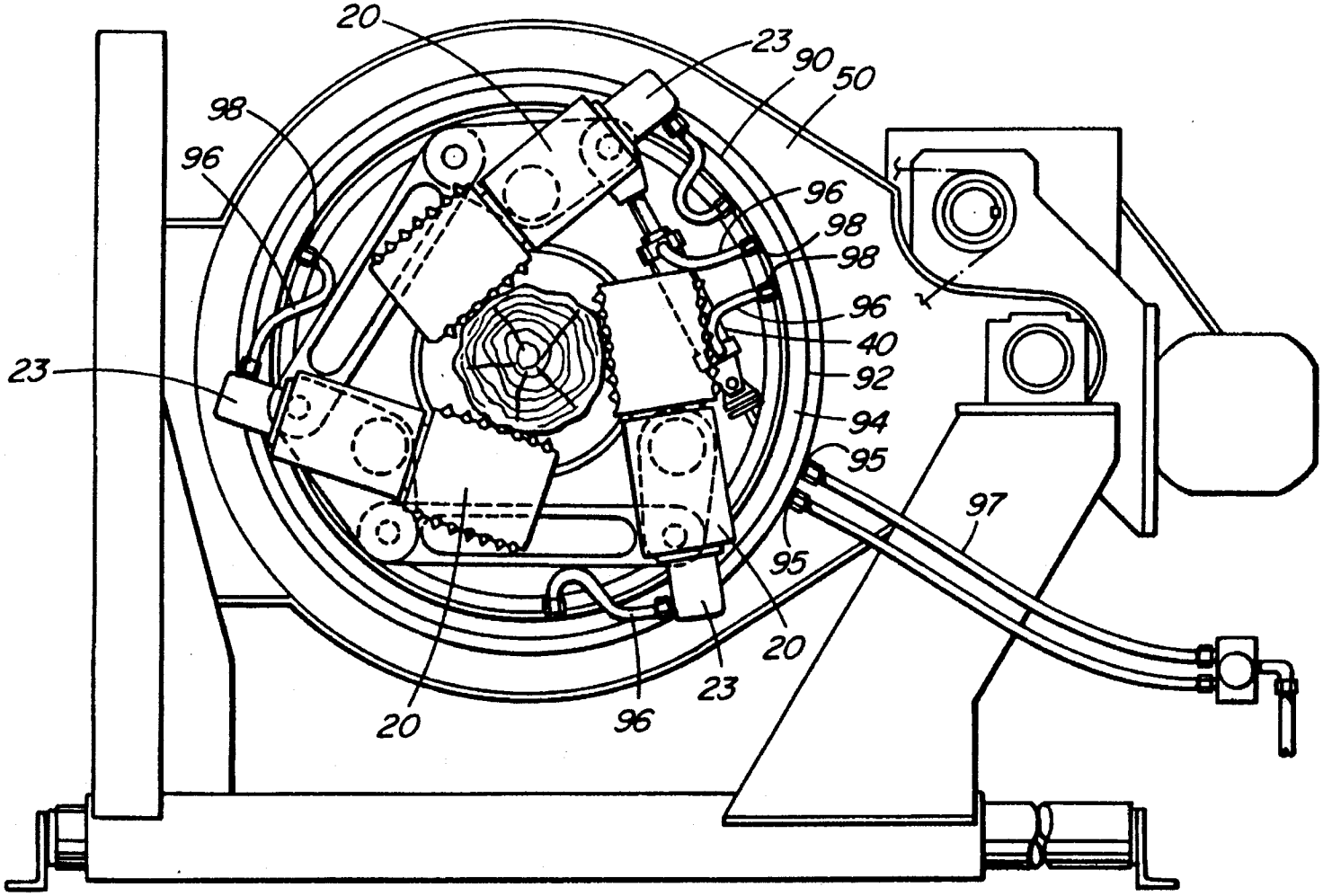
FIG. 5 is an elevation view of an alternative hydraulic fluid distribution system.

As previously mentioned, it is preferable that the gripping members 20 are driven by hydraulic motors 23 and positioned by hydraulic cylinder 40. FIGS. 4 and 5 illustrate various distribution systems for delivering hydraulic fluid to the hydraulic actuators. It must be remembered that the hydraulic equipment associated with rotatable housing 16 must move with the housing independently of the main frame.

In FIG. 4, a first hydraulic distribution system is shown comprising a manifold 80 fixedly mounted to the rotatable housing with lines 82 for delivering hydraulic fluid to operate the hydraulic motors 23 and cylinder 40. Hydraulic hoses 82 deliver hydraulic fluid from a source (not-shown) through valves 84 to manifold 80, the hoses being of sufficient length to permit rotation of the rotatable housing through at least 180 degrees. Hoses 82 are stored or released from about housing 16 as the rotatable housing is rotated.

FIG. 5 shows alternative hydraulic fluid distribution means comprising a slip ring or rotary seal assembly 90 associated with rotatable housing 16. The slip ring assembly has an outer portion 92 that mounted to arm 50 and is stationary with respect to the rotatable housing and an inner portion 94 that moves with the rotatable housing. The slip ring assembly defines a reservoir of hydraulic fluid between the inner and outer portions. A first set of hydraulic hoses 97 connect the reservoir to a source of hydraulic fluid via ports 95 on the stationary outer portion. A second set of hydraulic hoses 96 connect the reservoir of the slip ring assembly with hydraulic motors 23 and cylinder 40 via ports 98 on the movable inner portion 94. This arrangement avoids the need for long hydraulic hoses to accommodate rotary motion of housing 16.

In the event that electric or pneumatic actuators are used instead of hydraulic ones, similar power distribution systems can be used in which the lines carry electricity or air under pressure rather than hydraulic fluid.

Although the present invention has been described in some detail by way of example for purposes of clarity and understanding, it will be apparent that certain changes and modifications may be practised within the scope of the appended claims.

I claim:

1. Apparatus for rotating a log delivered by an infeed conveyor about its longitudinal axis for delivery to an outfeed conveyor comprising:

a main frame;

a rotatable housing mounted in the main frame having a passage therethrough to receive a log from the infeed conveyor;

log gripping members that are pivotable into the passage in a plane perpendicular to the passage to define an adjustable opening therebetween to receive logs of different dimensions, each log gripping member comprising an actuator and a spike roll mounted to the actuator for rotary motion, the spike rolls of the gripping members co-operating to engage and advance the log along its longitudinal axis through the passage to the outfeed conveyor, the log gripping members being mounted to the rotatable housing for movement with the housing; and drive means to rotate the rotatable housing through a selected angle to rotate the longitudinal axis of the log held in the log gripping members.

2. Apparatus as claimed in claim 1 in which the plurality of pivotable gripping members are joined by linking means for co-ordinated movement and an actuator associated with the linking means controls movement of the linking means.

3. Apparatus as claimed in claim 2 including power distribution means to operate the actuators.

4. Apparatus as claimed in claim 3 in which the actuators are powered by hydraulic fluid and the power distribution means comprises:

a manifold mounted to the rotatable housing with lines for delivering hydraulic fluid to operate the hydraulic actuators; and hydraulic hoses to deliver hydraulic fluid from a source to the manifold, the hoses being of sufficient length to permit rotation of the rotatable housing through at least 360 degrees.

5. Apparatus as claimed in claim 4 including reel means associated with the rotatable housing to accumulate and release the hydraulic hoses as the rotatable housing is rotated.

6. Apparatus as claimed in claim 3 in which the actuators are powered by hydraulic fluid and the power distribution means comprises:

a slip ring assembly associated with the rotatable housing having an outer portion stationary with respect to the rotatable housing and an inner portion that moves with the rotatable housing, the slip ring defining a reservoir of hydraulic fluid between the inner and outer portions;

a first set of hydraulic hoses connecting the reservoir to a source of hydraulic fluid via ports on the stationary outer portion; and a second set of hydraulic hoses connecting the reservoir of the slip ring assembly with the hydraulic actuators via ports on the movable inner portion.

7. Apparatus as claimed in claim 2 in which the actuators are electrically driven.

8. Apparatus as claimed in claim 2 in which the actuators are pneumatically driven.

9. Apparatus as claimed in claim 1 in which the main frame includes means for adjusting the position of the rotatable housing for alignment with the longitudinal axis of logs fed from the infeed conveyor.

10. Apparatus as claimed in claim 9 in which the means for adjusting the position of the rotatable housing comprises an arm pivotally mounted to the main frame, the arm including the rotatable housing, and means to pivot the arm to raise or lower the position of the rotatable housing.

11. Apparatus as claimed in claim 10 in which the arm is pivotally mounted to the main frame at one end and is free at the other end, the means to pivot the main arm comprising a hydraulic cylinder to engage the free end of the arm.

12. Apparatus as claimed in claim 11 in which the position of the arm is controlled by sensor equipment upstream of the apparatus for determining the cross-sectional area of the log, the sensor equipment providing a control signal to adjust the extension of the hydraulic cylinder.

13. Apparatus as claimed in claim 1 in which the drive means is controlled by sensor equipment upstream of the apparatus for determining the cross-sectional area of the log and determining the orientation of the log for maximum recovery in downstream processing equipment.

14. Apparatus as claimed in claim 13 in which the sensor equipment sends a signal to the drive means which causes the drive means to rotate the rotatable housing through an angle corresponding to the angle necessary to orient the log for maximum recovery.

15. Apparatus as claimed in claim 1 in which the rotatable housing comprises a cylindrical member supported in the main frame for rotatable movement by at least one bearing.

16. Apparatus as claimed in claim 15 in which the cylindrical member has an attached drive pulley and the drive means comprises a motor and a belt extending between the motor and the drive pulley.

* * * * *